US007303027B1

(12) United States Patent
Laemmer

(10) Patent No.: US 7,303,027 B1
(45) Date of Patent: Dec. 4, 2007

(54) GROUNDING ROD DRIVING SYSTEM

(76) Inventor: Rolf G. Laemmer, 19 Shuffstall St., Franklin, PA (US) 16323

( * ) Notice: Subject to any disclaimer, the term of this patent is extended or adjusted under 35 U.S.C. 154(b) by 0 days.

(21) Appl. No.: 11/460,113

(22) Filed: Jul. 26, 2006

(51) Int. Cl.
*B25D 1/04* (2006.01)
*E02D 7/04* (2006.01)

(52) U.S. Cl. ..... 173/91; 173/90; 173/132; 405/232

(58) Field of Classification Search ..... 173/90, 173/91, 132, 128; 405/232; 227/147
See application file for complete search history.

(56) References Cited

U.S. PATENT DOCUMENTS 1,262,960 A * 4/1918 Lea ..... 279/19
2,055,898 A * 9/1936 Huffman ..... 279/19
2,759,486 A * 8/1956 Pesaturo ..... 135/16
4,231,435 A * 11/1980 Andreasson ..... 173/128
4,241,795 A * 12/1980 Landry, Jr. ..... 173/90
4,268,926 A * 5/1981 Roxton ..... 7/143
4,299,021 A * 11/1981 Williams ..... 29/432
4,557,409 A 12/1985 Hecock et al.
D284,930 S 8/1986 Richards
4,641,715 A * 2/1987 Stinson et al. ..... 173/129
5,010,710 A 4/1991 Gray et al.
5,332,047 A * 7/1994 Hignite ..... 173/1
5,337,836 A * 8/1994 Williams ..... 173/90
5,863,154 A 1/1999 Olsen
5,934,139 A * 8/1999 Tucker ..... 72/479
6,347,672 B1 * 2/2002 Reardon ..... 173/90

* cited by examiner

*Primary Examiner*—Scott A. Smith

(57) ABSTRACT

A grounding rod driving system for facilitating installation and extraction of a grounding rod includes a sleeve slidably receiving a grounding rod. The sleeve slides along the grounding rod when the grounding rod is being driven into a support surface. A driver is coupled to a top end of the sleeve. The driver impacts the grounding rod to drive the grounding rod into the support surface when the sleeve is slid downwardly onto the grounding rod.

7 Claims, 6 Drawing Sheets

GROUNDING ROD DRIVING SYSTEM

BACKGROUND OF THE INVENTION

1. Field of the Invention

The present invention relates to grounding rod installers and more particularly pertains to a new grounding rod installer for facilitating installation and extraction of a grounding rod.

2. Description of the Prior Art

The use of grounding rod installers is known in the prior art. The prior art commonly teaches the use of a hydraulic driving means to drive a grounding rod. Additionally, the prior art requires a system that must be continuously moved along and secured to the grounding rod in multiple locations to facilitate driving of the grounding rod. While these devices fulfill their respective, particular objectives and requirements, the need remains for a system that has certain improved features that allows for a grounding rod to be driven by hand and is not secured to the grounding rod when the grounding rod is being driven. Additionally, the system facilitates the removal of the grounding rod by hand.

SUMMARY OF THE INVENTION

The present invention meets the needs presented above by generally comprising a sleeve slidably receiving a grounding rod. The sleeve slides along the grounding rod when the grounding rod is being driven into a support surface. A driver is coupled to a top end of the sleeve. The driver impacts the grounding rod to drive the grounding rod into the support surface when the sleeve is slid downwardly onto the grounding rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
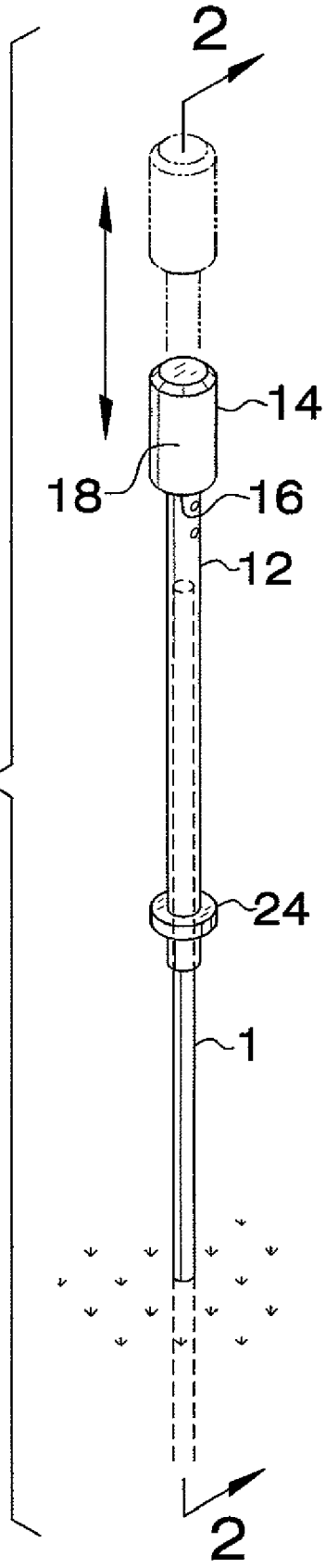
FIG. 1 is a perspective view of a grounding rod driving system according to the present invention.
Figure 2:
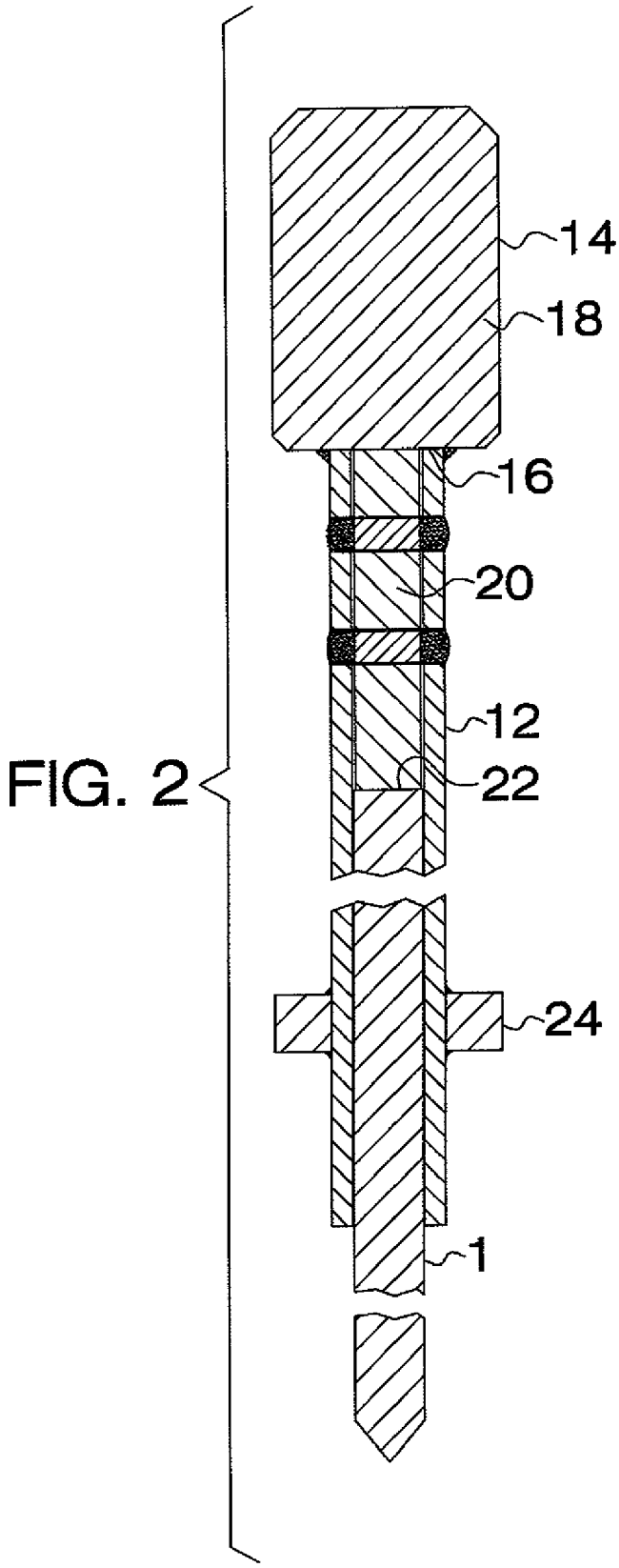
FIG. 2 is a cross-sectional view of the present invention taken along line 2-2 of FIG. 1.
Figure 3:
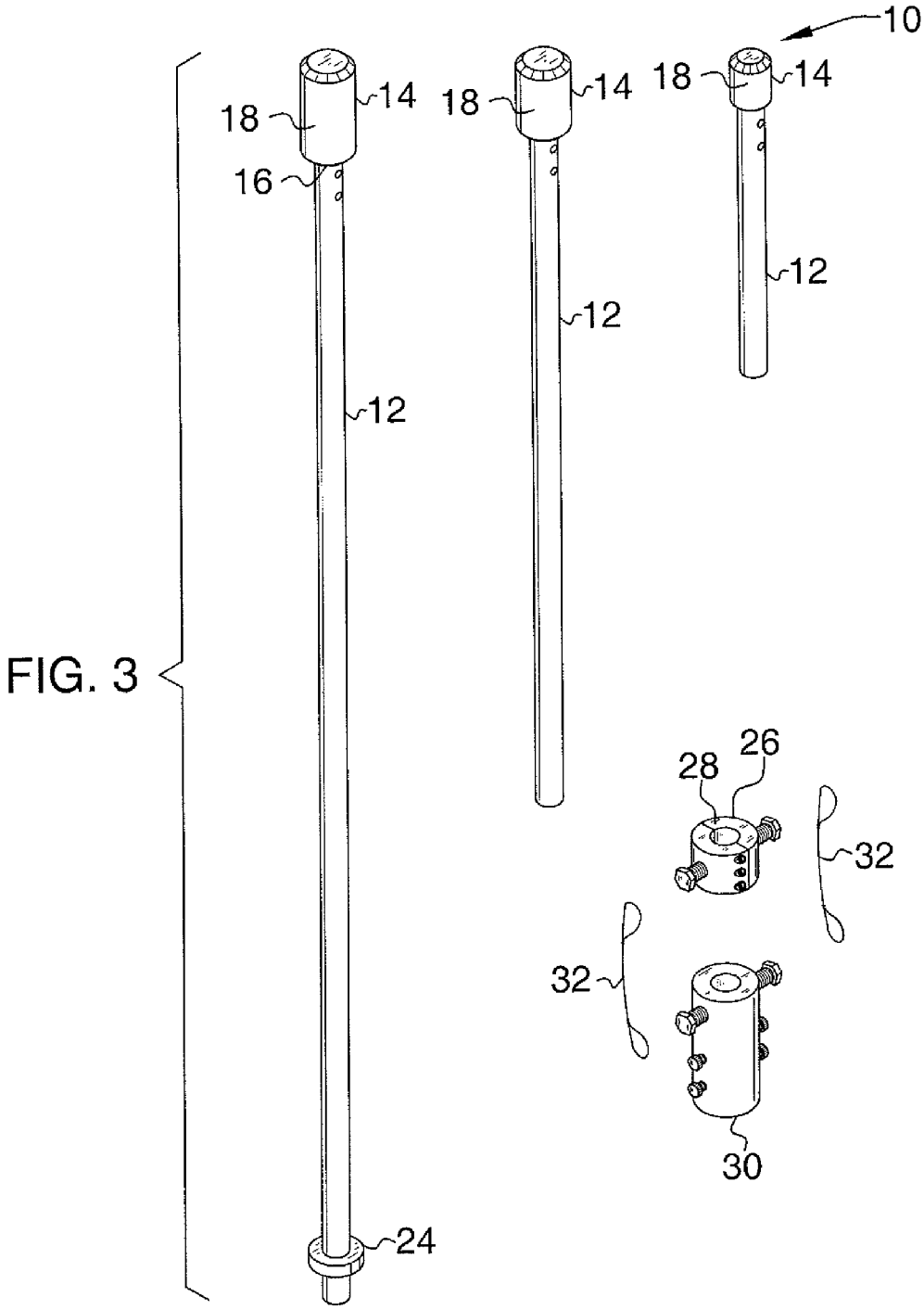
FIG. 3 is an exploded perspective view of the present invention.
Figure 4:
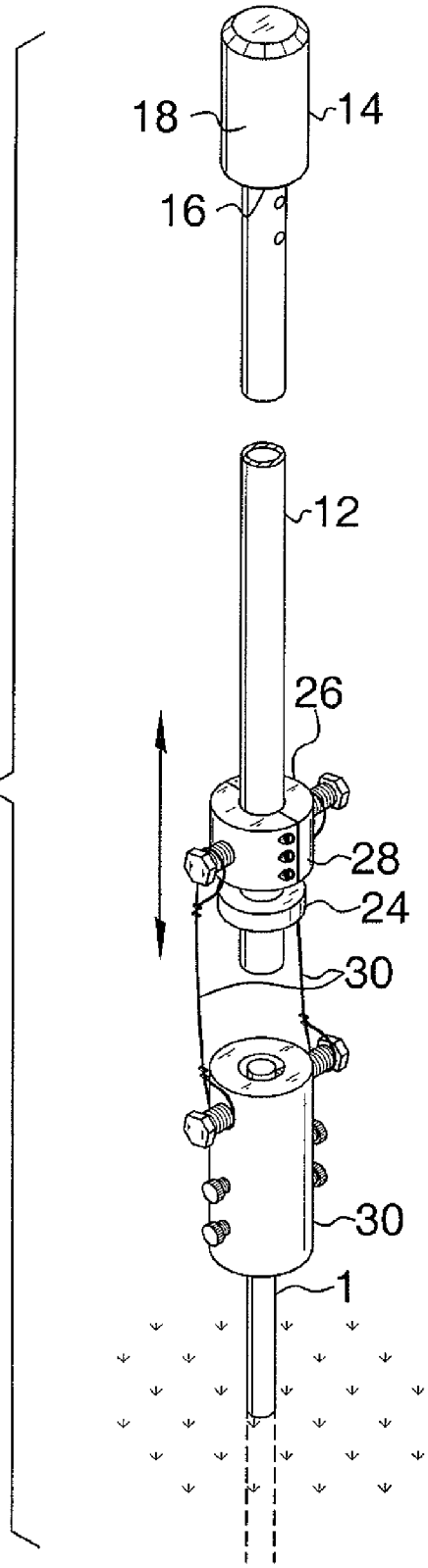
FIG. 4 is a perspective view of the present invention with the extraction assembly in place.
Figure 5:
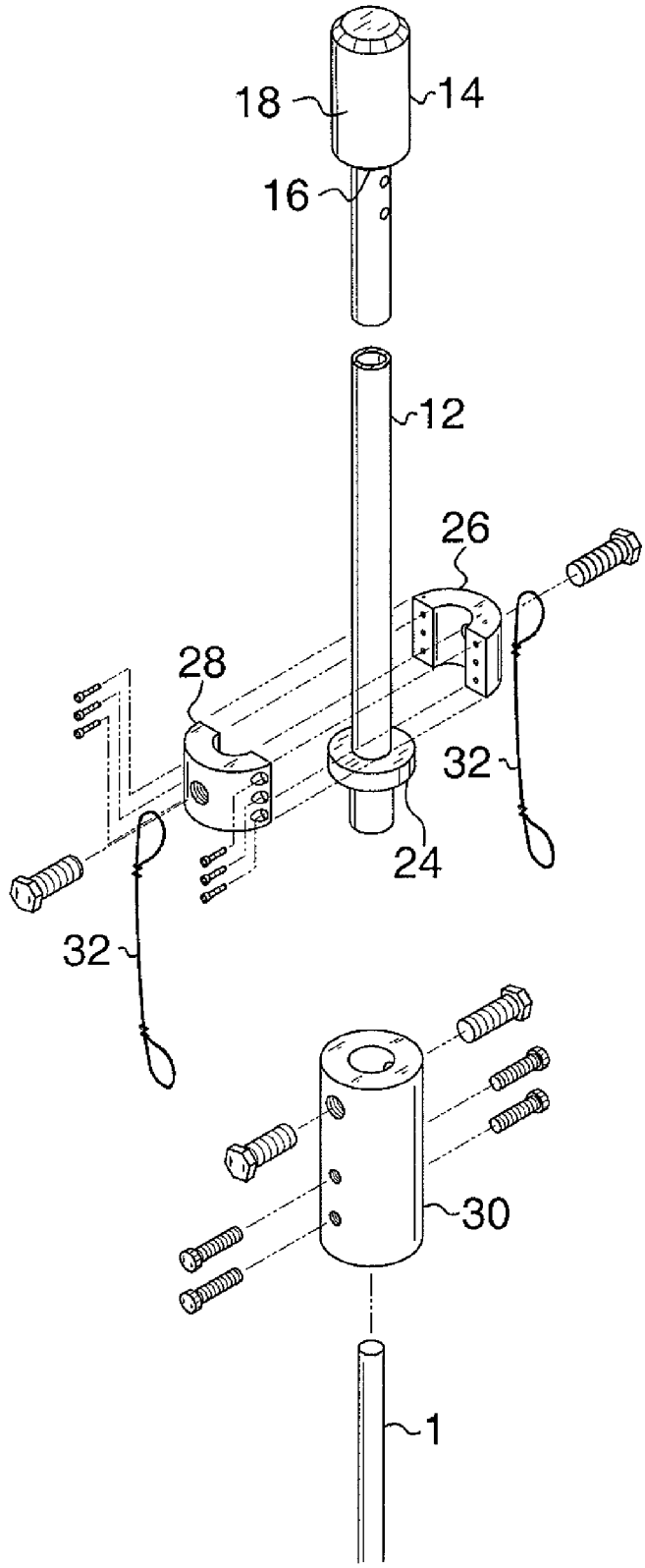
FIG. 5 is an exploded perspective view of the extraction assembly of the present invention.

With reference now to the drawings, and in particular to FIGS. 1 through 5 thereof, a new grounding rod installer embodying the principles and concepts of the present invention and generally designated by the reference numeral 10 will be described.

As best illustrated in FIGS. 1 through 5, the grounding rod driving system 10 generally comprises a sleeve 12 slidably receiving a grounding rod 1. The sleeve 12 slides along the grounding rod 1 when the grounding rod 1 is being driven into a support surface. A driver 14 is coupled to a top end 16 of the sleeve 12. The driver 14 impacts the grounding rod 1 to drive the grounding rod 1 into the support surface when the sleeve 12 is slid downwardly onto the grounding rod 1. The driver 14 includes a mass portion 18 coupled to the top end 16 of the sleeve 12. The mass portion 18 has a weight to facilitate driving of the grounding rod 1 into the support surface. The driver 14 includes an insertion rod 20 coupled to the mass portion 18. The insertion rod 20 is inserted to the top end 16 of the sleeve 12 and coupled to the sleeve 12. A distal end 22 of the insertion rod 20 opposite the mass portion 18 impacts the grounding rod 1 when the driver 14 is used to drive the grounding rod 1 into the support surface.

A flange 24 is coupled to the sleeve 12 opposite the driver 14. The flange 24 is positioned orthogonal to the sleeve 12 and radially extends outwardly from the sleeve 12. An extraction assembly 26 is mountable to the sleeve 12 and the grounding rod 1. The extraction assembly 26 extracts the grounding rod 1 from the support surface when the sleeve 12 is thrust away from the grounding rod 1. The extraction assembly 26 includes a sliding collar 28 slidably mountable to the sleeve 12. The sliding collar 28 is positioned between the flange 24 and the top end 16 of the sleeve 12.

The extraction assembly 26 also includes a locking collar 30 selectively mountable to the grounding rod 1. Each of a plurality of tethers 32 is couplable to and extends between the sliding collar 28 and the locking collar 30. The tethers 32 transfer upward force applied to the sliding collar 28 by the flange 24 to the locking collar 30 when the sleeve 12 is thrust upwards to remove the grounding rod 1 from the support surface.

Figure 6:
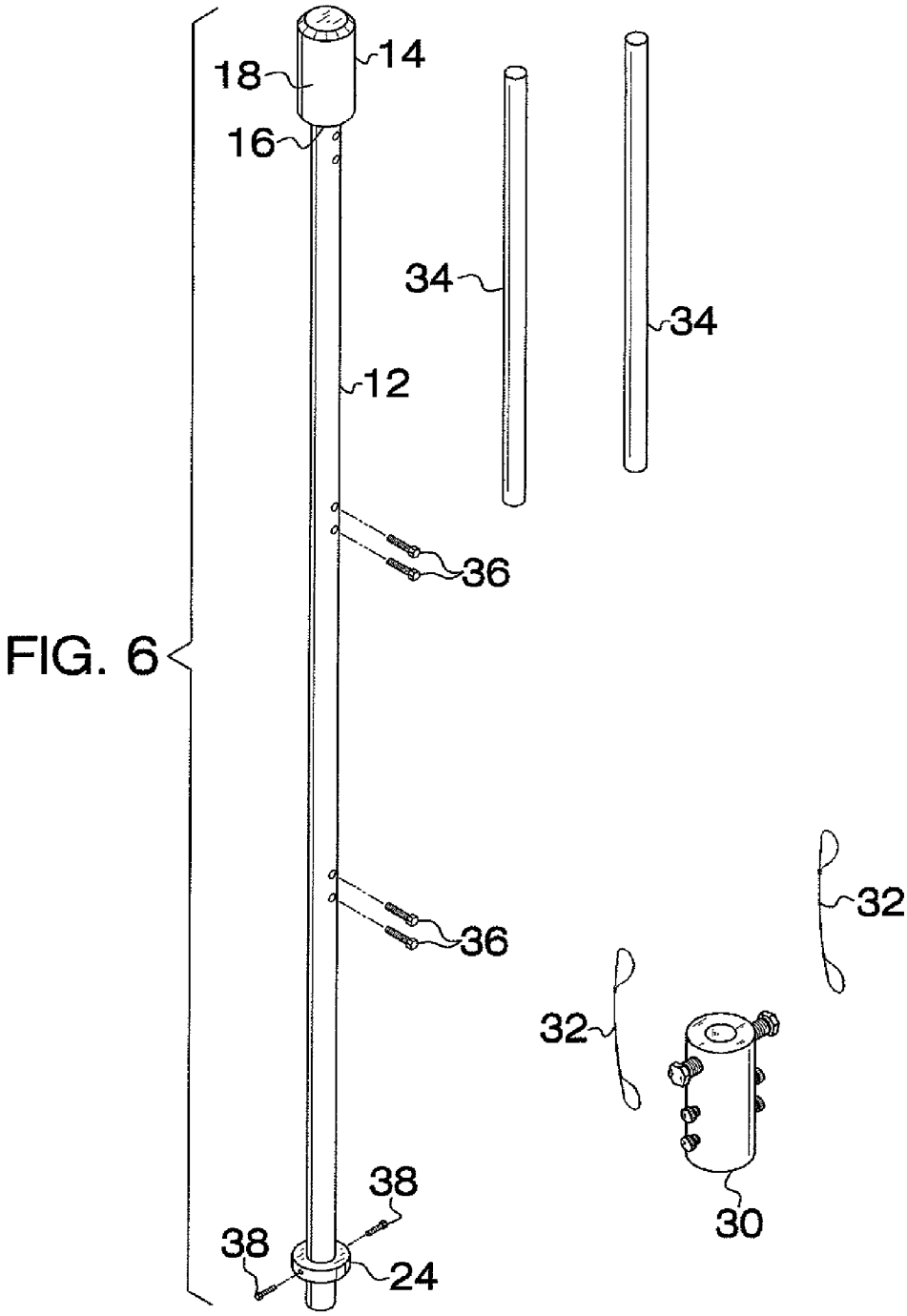
FIG. 6 is exploded view of an embodiment of the present invention.

In an embodiment, as shown in FIG. 6, a plurality of spacer rods 34 are selectively inserted into the sleeve 12 and are secured in the sleeve 12 by set screws 36 that extend though the sleeve 12 and engage the spacer rods 34. The spacer rods 34 are positioned between the grounding rod 1 and the driver 14 when the grounding rod 1 has reached a depth that the sleeve 12 and driver 14 can no longer drive the grounding rod 1. Additionally, a pair of lugs 38 may be threadably coupled to the flange 24. The tethers 32 are connected to the lugs 38 when the grounding rod 1 is to be withdrawn from the ground.

In use, the grounding rod 1 is positioned on the support surface and the sleeve 12 slid onto the grounding rod 1 opposite the support surface. The sleeve 12 is then slid downwardly onto the grounding rod 1 so that the driver 14 impacts the grounding rod 1 to drive the grounding rod 1 into the support surface. The process is repeated until the grounding rod 1 is driven into the support surface a desired distance. To facilitate removal of the grounding rod 1 from the support surface, the sliding collar 28 is positioned around the sleeve 12 between the flange 24 and the driver 14. The locking collar 30 is secured to the grounding rod 1 so that the locking collar 30 does not slide on the grounding rod 1. The tethers 32 are secured between the sliding collar 28 and the locking collar 30. As the sleeve 12 is thrust upwardly the flange 24 impacts the sliding collar 28 and the tethers 32 transfer that upward force to the locking collar 30 to extract the grounding rod 1 from the support surface.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A grounding rod driving system for driving and removing a grounding rod from a support surface, said system comprising:

a sleeve slidably receiving the grounding rod, said sleeve sliding along the grounding rod when the grounding rod is being driven into the support surface;

a driver being coupled to a top end of said sleeve, said driver impacting the grounding rod to drive the grounding rod into the support surface when the sleeve is slid downwardly onto the grounding rod;

a flange being coupled to said sleeve opposite said driver, said flange being positioned orthogonal to said sleeve and radially extending from said sleeve;

an extraction assembly being mountable to said sleeve and the grounding rod, said extraction assembly extracting the grounding rod from the support surface when said sleeve is thrust away from the grounding rod, said extraction assembly including:

a sliding collar being slidably mountable to said sleeve, said sliding collar being positioned between said flange and said top end of said sleeve;

a locking collar being removably mountable to the grounding rod;

a plurality of tethers, each of said tethers being couplable to and extending between said sliding collar and said locking collar, said tethers transferring upward force applied to said sliding collar by said flange to said locking collar when said sleeve is thrust upwards to remove the grounding rod from the support surface.

2. The system according to claim 1, wherein said driver includes a mass portion being coupled to said top end of said sleeve, said mass portion having a weight to facilitate driving of the grounding rod into the support surface.

3. The system according to claim 2, wherein said driver includes an insertion rod coupled to said mass portion, said insertion rod being inserted to said top end of said sleeve and coupled to said sleeve, a distal end of said insertion rod opposite said mass portion impacting the grounding rod when said driver is used to drive the grounding rod into the support surface.

4. The system according to claim 1, wherein said extraction assembly includes a pair of lugs, each of said lugs threadably engaging said sliding collar and extending outwardly from said flange, each of said tethers being couplable to and extending between said lugs and said locking collar, said tethers transferring upward force applied to said lugs by said flange to said locking collar when said sleeve is thrust upwards to remove the grounding rod from the support surface.

5. The system according to claim 1, further comprising a plurality of spacer rods, each of said spacer rods being inserted within said sleeve and positioned between said driver and the grounding rod when the grounding has reached a depth to longer be driven by said sleeve and driver.

6. The system according to claim 5, further comprising a plurality of set screws, each of said set screws extending through said sleeve and engaging one of said spacer rods to secure said spacer rods in said sleeve.

7. A grounding rod driving system for driving and removing a grounding rod from a support surface, said system comprising:

a sleeve slidably receiving the grounding rod, said sleeve sliding along the grounding rod when the grounding rod is being driven into the support surface;

a driver being coupled to a top end of said sleeve, said driver impacting the grounding rod to drive the grounding rod into the support surface when the sleeve is slid downwardly onto the grounding rod, said driver including a mass portion being coupled to said top end of said sleeve, said mass portion having a weight to facilitate driving of the grounding rod into the support surface, said driver including an insertion rod coupled to said mass portion, said insertion rod being inserted to said top end of said sleeve and coupled to said sleeve, a distal end of said insertion rod opposite said mass portion impacting the grounding rod when said driver is used to drive the grounding rod into the support surface;

a flange being coupled to said sleeve opposite said driver, said flange being positioned orthogonal to said sleeve and radially extending from said sleeve;

an extraction assembly being mountable to said sleeve and the grounding rod, said extraction assembly extracting the grounding rod from the support surface when said sleeve is thrust away from the grounding rod, said extraction assembly comprising;

a sliding collar being slidably mountable to said sleeve, said sliding collar being positioned between said flange and said top end of said sleeve;

a locking collar being selectively mountable to the grounding rod; and a plurality of tethers, each of said tethers being couplable to and extending between said sliding collar and said locking collar, said tethers transferring upward force applied to said sliding collar by said flange to said locking collar when said sleeve is thrust upwards to remove the grounding rod from the support surface.

* * * * *